United States Patent [19]

Barry et al.

[11] Patent Number: 4,898,197

[45] Date of Patent: Feb. 6, 1990

[54] CLEANING OF TUBES USING PROJECTILES

[75] Inventors: Peter L. Barry, Blackburn; Robert W. Vowles, Flemington, both of Australia

[73] Assignee: Lacress Nominees Pty. Ltd., Camberwell, Australia

[21] Appl. No.: 120,942

[22] Filed: Nov. 16, 1987

Related U.S. Application Data

[63] Continuation-in-part of Ser. No. 858,859, Apr. 30, 1986, Pat. No. 4,724,007, which is a continuation of Ser. No. 648,882, Sep. 10, 1984, abandoned, which is a continuation-in-part of Ser. No. 527,269, Aug. 29, 1983, abandoned.

[30] Foreign Application Priority Data

Mar. 11, 1983 [AU] Australia ..... 12433/83
Aug. 17, 1984 [WO] PCT Int'l Appl. ..... PCT/AU84/00159

[51] Int. Cl.[4] ..... B08B 9/04

[52] U.S. Cl. ..... 134/8; 134/8; 134/22.11; 134/22.12

[58] Field of Search ..... 15/3.5, 3.51, 104.05, 15/104.061, 104.062, 104.07; 134/1, 8, 22.11, 22.12, 24, 166 R, 184

[56] References Cited

U.S. PATENT DOCUMENTS

| | | | |
|---|---|---|---|
| 1,034,301 | 7/1912 | Redeker | 134/17 |
| 1,806,270 | 5/1931 | Thompson | 15/3.5 |
| 2,874,078 | 2/1959 | Reinhart | 134/8 |
| 3,148,689 | 9/1964 | Bean et al. | 15/104.062 |
| 3,409,470 | 11/1968 | Karpouich | 134/17 |
| 3,451,091 | 6/1969 | Wallace | 15/3.5 |
| 3,531,813 | 10/1970 | Hurst | 15/104.062 |
| 3,562,014 | 2/1971 | Childers et al. | 134/8 |
| 3,631,555 | 1/1972 | Hurst et al. | 15/3.5 |
| 3,914,815 | 10/1975 | Kobayashi | 15/3.5 |
| 4,252,255 | 2/1981 | Henderson | 15/3.5 |
| 4,353,414 | 10/1982 | Leitner | 134/8 |
| 4,467,488 | 8/1984 | Creek | 15/3.5 |
| 4,716,611 | 1/1988 | Barry | 15/3.51 |
| 4,724,007 | 2/1988 | Barry et al. | 134/1 |

*Primary Examiner*—W. Gary Jones
*Attorney, Agent, or Firm*—Robert F. O'Connell

[57] ABSTRACT

Tubes are cleaned using projectiles propelled by the more or less instantaneous release of liquid cleaning medium at high pressure acting upon one face of the projectile. Projectiles travel at a velocity of at least about 10 m $sec^{-1}$ inducing a cavitation-like process to the rear of said projectile.

11 Claims, 1 Drawing Sheet

CLEANING OF TUBES USING PROJECTILES

This is a continuation-in-part of application No. 858,859, filed on Apr. 30, 1986, now U.S. Pat. No. 4,724,007, which was a continuation Ser. No. 648,882 filed on Sept. 10, 1984, now abandoned, which was a continuation-in-part of Ser. No. 527,269 filed on Aug. 29, 1983, now abandoned.

The most common forms of industrial heat transfer devices are boilers, condensers and heat exchangers. The usual embodiment of these devices is an outer shell or casing through which passes a plurality of tubes. One fluid medium passes through the tubes and another hotter or colder fluid medium passes through the shell around the outside of the tubes, giving up heat to or taking up heat from the first said fluid medium.

Both the inner and outer surfaces of tubes in such devices are subject to fouling which reduces the efficiency of heat transfer. As a result, it is usually necessary to clean the tubes on a regular basis.

The most common forms of tube cleaning are pigging and high pressure water lancing. In the former method, a pig fitted with scraping, brushing or abrading elements is forced through a tube at low speed by means of fluid pressure, mechanically removing contaminant material. In the latter method, a lance comprising a long rigid or flexible tube which terminates in a head provided with a plurality of orifices is inserted into a tube and highly pressurized water or some other suitable liquid cleaning medium is supplied through the said tube to the said orifices in the head. The lance is normally inserted into a tube by hand and energetic jets of water or cleaning medium emitted from the said orifices scour contaminant material from the walls of the tube and flush it away.

The present invention discloses a method of tube cleaning which is a continuation-in-part of that disclosed in patent application No. 858,859 and which involves the propelling of a projectile into and through a tube by means of a more or less instantaneous release against it of a supply of liquid cleaning medium at high pressure.

In the development of the original method the principal objective was to accelerate the projectile as rapidly as possible so as to generate a water hammer type shock when the projectile and its following column of cleaning medium were arrested by a heavy deposit of contaminant material. The water hammer type shock was sufficiently energetic to dislodge solid contaminant material from a tube. It has now been found that, when the method is performed on tubes containing thin laminar deposits of contaminant material, this material also is effectively removed. This is despite the fact that the projectile is a more or less simple, solid unitary cylinder of diameter less than that of the tube, and is therefore unable to perform the scraping function of a conventional pig The efficiency of this cleaning effect appears to be a function of the velocity of the projectile.

In practice, it has been found that the maximum rate of tube filling and, therefore, maximum projectile velocity (and as a result maximum cleaning efficiency) are achieved when:

(a) the internal diameter of the conduits and valves through which the supply of liquid cleaning medium is supplied to a tube to be cleaned is sufficiently large to minimize pressure drop between the said tube to be cleaned and the source of pressurized cleaning medium and (b) the pressure of the liquid cleaning medium at its source is between 1,000 and 12,000 psi.

It is possible, but unlikely, that the flow behind the projectile is a cavitating flow. It is possible that a toroidal vortex may be produced in the wake of the projectile, which produces a pressure drop of sufficient magnitude to trigger cavitation. Turbulence by itself appears to be insufficient to explain the cleaning process but it is likely that turbulence in the wake is a prerequisite for successful cleaning action. It may be that air passing round the projectile interacts with the liquid in the wake to generate a form of two-phase flow which has corrosive/cleansing properties similar to those of a cavitating flow.

The regime of operation of the tube cleaning apparatus which is of immediate interest is that in which lightly contaminated pipes are cleaned by using a flow of high pressure liquid cleaning medium to propel a loosely fitting projectile at high speed down the tube. The fact that the projectile fits loosely into the tube suggests that the projectile itself does not mechanically scrape the contaminant material from the tube walls. Also, it is observed that the contaminant material removed from the tube walls appears in the liquid cleaning medium following the projectile rather than ahead of the projectile. Little of the liquid cleaning medium is found to be ahead of the projectile at the end of its travel implying that strong wall shear due to high speed forward flow through the annular space between the tube wall and the projectile is also ruled out as a possible mechanism. When liquid cleaning medium is forced through the tubes without the projectile present, the tube walls are not cleaned with the same degree of efficiency.

These observations imply that it is the action of the liquid following the projectile that removes the contaminant and that the interaction of the flow and the projectile plays an important role in the process.

Reynolds Number is a measure of the ratio of the inertial forces to the viscous forces and is defined as $$R_e = \frac{\rho\, UL}{\mu}$$

where L is a typical dimension of the flow, $\rho$ is the density of the fluid, U the flow velocity, and $\rho$ is the molecular viscosity of the fluid. Flows with the same Reynolds Number and geometry can be expected to be dynamically similar. The density of water at 20° C. is 998 Kg/m$^3$. Taking the tube diameter as the dimension L, a typical Reynolds Number for the flows being considered is $1.2\times10^5$.

In any given geometry, there is a critical Reynolds Number. $R_{e\,crit}$ above which a flow is turbulent (randomly fluctuating, strongly mixing, energy dissipating) and below which the flow is laminar (smooth, non-fluctuating). Birkhoff and Garrett (Birkhoff, Garrett and Zarantonello, E. H. "Jets, Wakes and Cavities" Applied Mathematics and Mechanics Volume 2 (Academic Press, N.Y.) (1957) state that the critical Reynolds Numbers are typically in the region of $10^5$ to $5\times10^5$ over a large range of flow geometries. The present flow is therefore probably in the transition region for the present geometry and may be laminar or turbulent or a mixture of both.

It is interesting to note that the cleaning action becomes apparent at projectile velocities above about 10 m/s. i.e. in flows with Reynolds Number greater than $10^5$. Such flows may be expected to be turbulent. It is likely that, whatever mechanism performs the cleaning action, it is related to the turbulence of the flow.

The turbulence in the flow entering the tube in the absence of the projectile may be insufficient to cleanse the tube. Although the wake turbulence behind the projectile in the cleansing flow will be more intense than the projectile-free flow turbulence it would seem unlikely that the increase would, in itself, explain the dramatic improvement in cleansing action. The point is that the generation of a turbulent liquid cleaning medium flow in the tube appears insufficient to explain the cleaning process.

An alternative possibility is that air attached to the tube wall is being by-passed by the projectile and entrained in the flow of liquid cleaning medium behind it. Such a two-component gas/liquid flow might well have features which are analogous to true cavitating flow and which perform a similar corrosive/cleaning action. For example, the formation, growth, division and collapse of the air bubbles may produce corrosive action similar to the corresponding processes undergone by the vapor bubbles. There are, of course, great differences in the behavior of gas bubbles and vapor bubbles. One of the most important of these is that conversion of vapor into liquid occurs far more rapidly than the dissolving of air in water. The high pressures generated in the collapse of vapor bubbles is dependent on the rapid conversion from vapor to liquid. Additionally, there is no limit to the amount of vapor which can be "absorbed" in this way into the liquid whereas a saturation limit exists for air dissolved in water.

According to the present invention, there is provided a source of pressurized water or other suitable cleaning medium. Preferably, this is a "Triplex" positive displacement type pump, the output of which produces a pulsed flow containing up to 6,000 pulses per minute. The said pump is connected by conduits of suitable internal diameter to a quick opening valve also of suitable internal diameter, the said valve being mounted on or close to a moveable launcher. The said valve is connected to the said launcher which can be positioned collinear with and sealed to the opening of a tube to be cleaned. The said launcher may be simple in arrangement or may incorporate means to supply a projectile from a storage magazine to each tube to be cleaned. A projectile is placed in the end of a tube to be cleaned and the said launcher sealed to the opening of the tube. Preferably, projectiles are simple, unitary and incompressible and, in their simplest form, are cylindrical in shape. For particular purposes, projectiles may be made in other shapes ranging from that of a modified cylinder through to spherical. The diameter of a projectile is selected for a particular tube cleaning task. In the case of a tube contaminated with a light laminar layer, a projectile is selected with a diameter such that it would be a light sliding fit in the clean tube. In the case of a tube with a heavier laminar layer of contaminant material, the diameter of the projectile is selected to approximate the average lumen of the contaminated tube. With the said launcher in place over the end of a tube, opening the said quick opening valve fills the tube rapidly, causing the said projectile to pass through it at high speed. Where the output volume of the said cleaning medium supply pump is limited or the pressure drop in the conduit between it and the said quick opening valve is excessive, an accumulator of suitable capacity is positioned immediately upstream of the said quick opening valve. The said pump is then used to charge the said accumulator, the contents of which are discharged into a tube to be cleaned when the said quick opening valve is opened.

The present invention will be more readily understood by reference to the following description of a preferred embodiment given in relation to the accompanying drawings in which.

Figure 1:
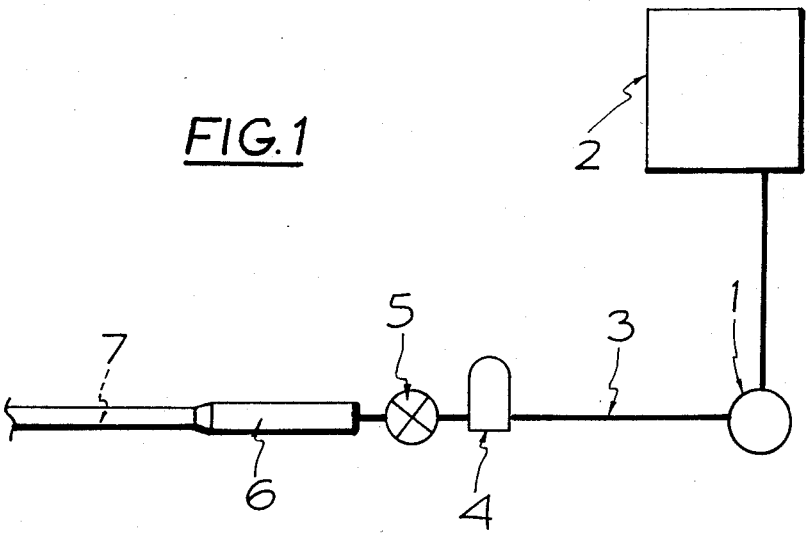
FIG. 1 is a diagram of the arrangement of a cleaning medium supply system.

With reference to FIG. 1, pump 1 takes liquid cleaning medium from reservoir 2 and passes it through conduit 3 to optional accumulator 4. The opening of quick opening valve 5 permits pump output flow or the contents of accumulator 4 to pass through launcher 6 to tube to be cleaned 7.

Figure 2:
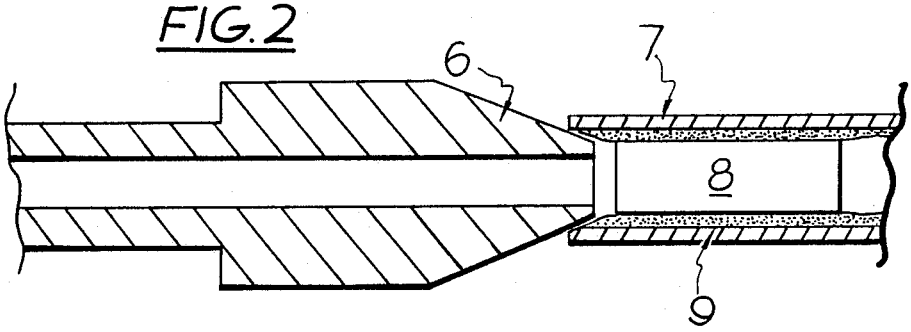
FIG. 2 depicts a longitudinal cross-sectional view of a launcher sealingly engaged to the end of a tube to be cleaned.

With reference to FIG. 2, launcher 6 is sealingly engaged with the opening of tube to be cleaned 7. Projectile 8 is sized to conform to the average lumen created by contaminant material 9.

Figure 3:
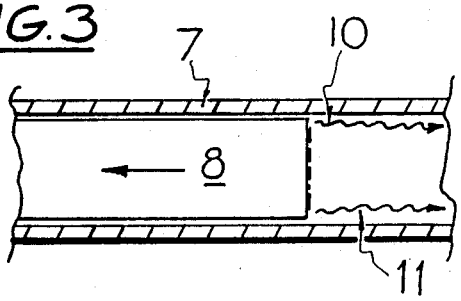
FIG. 3 depicts a longitudinal cross-sectional view of a projectile travelling in a tube.

With reference to FIG. 3, forward motion of projectile 8 through tube 7 generates wake turbulence at regions 10 and 11.

We claim:

1. A method of cleaning tubes, using at least one solid substantially incompressible projectile having an outer diameter no greater than that which forms a loose sliding fit within a tube to be cleaned, wherein said projectile is propelled through said tube by a substantially instantaneous release of a flow of a pressurized cleaning liquid against one surface of said projectile, said projectile being propelled through said tube ahead of substantially all of the cleaning liquid at a speed of at least ten meters per second, such that cavitation-like turbulence is produced rearwardly of the projectile to effect cleaning of said tube as the projectile travels along said tube, and said projectile is propelled without substantial mechanical scraping contact with the inner walls of said tube.

2. The method as claimed in claim 1 wherein the projectile is simple, unitary and not fitted with scraping, abrading or brushing elements.

3. The method as claimed in claim 1 wherein the projectile is simple, unitary and cylindrical in shape.

4. The method as claimed in claim 1 wherein the projectile is simple, unitary and spherical in shape.

5. The method as claimed in claim 1 wherein said liquid is water.

6. The method as claimed in claim 1 wherein said projectile is of ice.

7. A method of cleaning tubes according to claim 1 wherein the diameter of the projectile is dimensioned to conform with an average lumen diameter defined by deposits on the inner wall of said tube.

8. The method as claimed in claim 7 wherein the projectile is simple, unitary and not fitted with scraping, abrading or brushing elements.

9. The method as claimed in claim 7 wherein the projectile is simple, unitary and either cylindrical or spherical in shape.

10. The method as claimed in claim 7 wherein said liquid is water.

11. The method as claimed in claim 7 wherein said projectile is of ice.

* * * * *